US006034473A

United States Patent [19]

McBride, Jr. et al.

[11] Patent Number: 6,034,473

[45] Date of Patent: Mar. 7, 2000

[54] LIGHTING SYSTEM AND LAMP WITH OPTIMAL FILAMENT PLACEMENT

[75] Inventors: Edward J. McBride, Jr.; Kenyon C. Whitright, both of Colorado Springs, Colo.

[73] Assignee: Wybron, Inc., Colorado Springs, Colo.

[21] Appl. No.: 08/979,747

[22] Filed: Nov. 26, 1997

[51] Int. Cl.[7] ..... H01K 1/02

[52] U.S. Cl. ..... 313/578; 313/273

[58] Field of Search ..... 313/113, 272, 313/273, 578; 362/296, 341, 347, 350

[56] References Cited

U.S. PATENT DOCUMENTS

| | | | |
|---|---|---|---|
| 2,218,345 | 10/1940 | Spaeth | 313/578 |
| 3,286,116 | 11/1966 | Malm | 313/272 X |
| 5,072,147 | 12/1991 | Pugh et al. | 313/341 |
| 5,268,613 | 12/1993 | Cunningham | 313/113 |
| 5,446,637 | 8/1995 | Cunningham et al. | 362/321 |

OTHER PUBLICATIONS

*Bulb Direct*, Replacement Lamps for Your Equipment, formely known as PSC Lamps, Inc., 1997 Catalog.

*Primary Examiner*—Stephen Husar

*Attorney, Agent, or Firm*—John R. Wahl; Holland & Hart LLP

[57] ABSTRACT

A lighting system for projecting a beam of light has a light source and a concave reflector having a central axis. The center of the light source is located at a position other than at the focal point of the reflector, i.e. between the reflector surface and the focal point of the reflector for an ellipsoidal reflector and forward of the focal point for a parabolic reflector. This placement provides a greater light output than is achievable by positioning the light source at the focal point of the reflector. The preferred light source is an improved lamp having an incandescent filament having a central linear helical portion aligned with a central axis of the reflector and a peripheral helix portion around the central portion so as to concentrate the emission of light along and about the central axis of the filament.

10 Claims, 5 Drawing Sheets

LIGHTING SYSTEM AND LAMP WITH OPTIMAL FILAMENT PLACEMENT

BACKGROUND OF THE INVENTION

1. Field of the Invention

This invention relates generally to lighting assemblies for projecting a beam of light and more particularly to a system having a reflector and a light source wherein the source of light is optimally placed with reference to the reflector.

2. Description of the Related Art

Ellipsoidal spotlights have been used for a number of years in the theatrical industry. An example of such a spotlight is described in U.S. Pat. Nos. 5,345,371 and 5,446,637. These particular theatrical ellipsoidal spotlights have a near-elliptical reflector and an incandescent lamp that has four linear, helically wound coil filaments that are spaced around the central longitudinal axis of the lamp and extend parallel to the central axis of the lamp. The lamp, in turn is positioned through a coaxial aperture in the rear of the reflector so that the lamp axis and the reflector axis coincide. The lamp is so designed that when the lamp is fully inserted and secured in place the filaments are located in a spaced relation around the focal point of the reflector. Such an arrangement is described in U.S. Pat. No. 5,268,613, issued to Cunningham. This patent teaches that for optimum illumination of the target, utilizing an ellipsoidal or parabolic reflector and an incandescent lamp, the filament should be coincident with the rough focal point of the reflector. Further, the filament axial length should be as short as possible in order to maximize light impingement on the reflector such that it is reflected through the spotlight's aperture. Further, the filaments should extend parallel to the central axis of the reflector with their centers as close to the focal point as possible. To that end, the Cunningham apparatus, one embodiment of which is commercially known as an ETC Source 4 lighting assembly, includes an adjustable feature to axially adjust the position of the incandescent bulb within a millimeter or two about the focal point to correct for manufacturing tolerances in axial placement of the filaments within the replaceable bulb. However, the placement of a filament directly on the central axis with its center at the focal point, is discouraged as counterproductive in that its light would be absorbed by the filaments spaced from the central axis. Further, the adjustability feature falls short of being capable of positioning the filaments in this prior-art bulb at the optimum axial location as discussed below with reference to the present invention.

The purpose of utilizing a reflector with a light source is to project a beam of light in a given direction, usually along the central axis, of the reflector. It is also desirable to project as much light as possible for a given power input to the light system. Consequently there is a continuing need for improved illumination and light projection from a given lighting fixture design.

SUMMARY OF THE INVENTION

The present invention provides such an improved illumination and light projection from a given lighting fixture design. Accordingly it is a primary object of the invention to provide a lighting system which projects a greater amount of light from a given light source off the reflector and toward a target for a given power input than has previously been achievable.

It is another object of the invention to provide a lamp having an improved optimal filament placement in a concave reflector/incandescent lamp light fixture system.

It is a still further object of the invention to provide a lamp having a near-spherical filament arrangement for use in a lighting fixture having a lamp and a concave reflector.

It is a still further object of the invention to provide an incandescent lamp having a near-cylindrical filament arrangement for use in a lighting fixture having a lamp and a concave reflector.

As a general convention throughout this specification, the use of the terms "parabolic reflector" and "ellipsoidal reflector" include near-parabolic reflectors and near-ellipsoidal reflectors. Similarly, the term focal point is meant to include focal regions as will occur in practically all real reflector designs such as in near-parabolic and near-ellipsoidal reflector designs. These latter designs include multiple reflector facets in order to preclude unwanted projected light concentration areas and project light beams having a generally uniform cross-sectional intensity distribution.

In accordance with the present invention the optimal placement of a point source of light in a lighting system comprising a concave reflector having a central longitudinal axis and at least one focal point is not at the focal point as is conventionally thought. Rather, the optimal placement of a light source for an elliptical reflector is in a region behind the reflector focal point, i.e., between the surface of the reflector and the focal point. In a system using a parabolic reflector, the optimum placement of the light source is in front of the focal point rather than at the focal point.

More particularly, one embodiment of a system in accordance with the present invention for projecting a beam of light comprises a substantially ellipsoidal curved reflector having a central axis therethrough and a focal point on the axis and a light source having an illuminating element therein positioned on the axis. The center of the illuminating element is positioned near the focal point but between the focal point and the substantially ellipsoidal reflector. The optimal placement of the light source or illuminating element is centered about a position behind the focal point generally about one tenth the axial distance between the near focal point and the reflector. The specific point depends upon the actual geometry of the reflector itself. For example, the optimal location has been found to be between about 1 millimeter and 5 millimeters axially behind the focal point of the reflector and preferably between about 1 and 3 mm behind the focal point for an ETC Source 4 lighting assembly. Thus, when a conventional lamp in a light system which includes a reflector, such as a theatrical spotlight, is repositioned with respect to the reflector from the region of the focal point to a position within this range behind the focal point of the reflector, a substantial improvement of illumination intensity being transmitted forward can be achieved.

The improved lamp for use in the system in accordance with the invention includes a filament having a linear, helically wound filament portion coaxially positioned along the central axis of the reflector and a spiral, helically wound peripheral portion wrapped around the linear central portion. One embodiment of the improved lamp for use in the system in accordance with the invention has the peripheral portion extending in a helix cylindrically around the central portion. Another embodiment of the lamp has the peripheral portion extending in a spherical helix around the central portion of the filament.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 1:
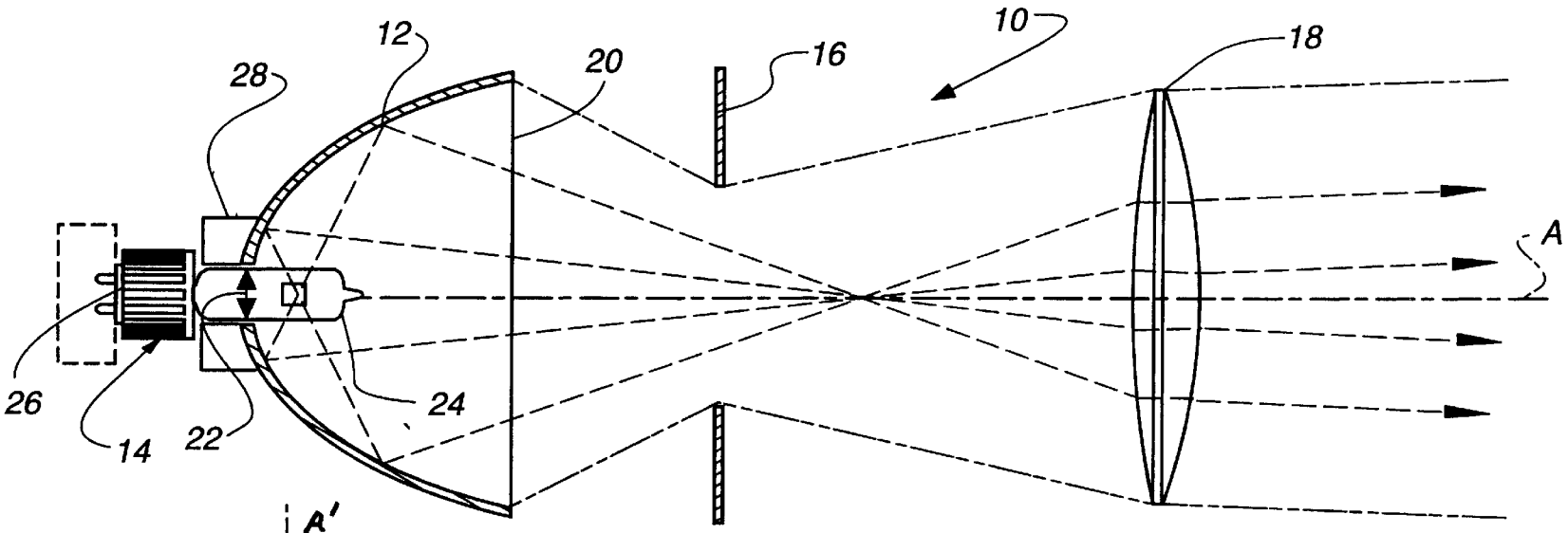
FIG. 1 is a schematic side view of a lighting system in accordance with the invention.
Figure 2:
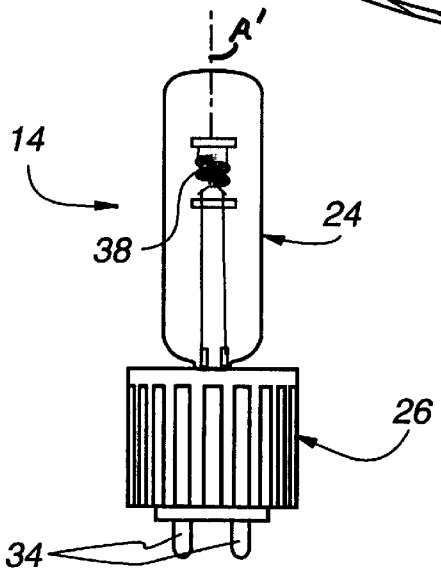
FIG. 2 is a side view of an incandescent lamp incorporating a filament in accordance with the invention.

Turning now to the drawing, FIG. 1 is a side view of a lighting system 10 in accordance with the invention including a reflector 12, a lamp 14, a gate or window 16 and a focusing lens 18. FIG. 2 is a separate view of one embodiment of the lamp 14 in accordance with the present invention. The reflector in FIG. 1 is an ellipsoidal reflector having a front edge 20, a central longitudinal axis A and a central lamp aperture 22 at its rear end through which the bulb portion 24 of the lamp 14 is inserted. The base portion 26 of the lamp 14 is fastened to a portion of the housing 28 which supports the reflector 12.

The reflector 12 is concave and preferably may have either an ellipsoidal or near-ellipsoidal shape or a parabolic or near-parabolic shape such as the faceted shape as described in one of the patents referred to above. In the case of an ellipsoidal or near-ellipsoidal reflector, the front edge 20 is generally between the foci of the ellipse, and closer to the focus within the reflecting surface. This is generally because having a front edge beyond the midpoint of the ellipse formed by the reflector would first be difficult to manufacture and second adversely impact illumination projection efficiency.

A side view of a lamp 14 in accordance with the present invention is shown in FIG. 2. This lamp 14 has a conventional base 26 which is mechanically fastened to the housing 28 adjacent the rear of the reflector 12 and electrically connected via pins 34 to a complementary socket (not shown). Integral with the base 26 is the bulb portion 24, preferably a clear glass envelope enclosing a filament 38 in accordance with the invention which is described in greater detail below. The base 26 is conventional in design. The glass envelope enclosing the filament 38 of the bulb portion 24 is preferably a clear quartz glass having a uniform wall thickness in order to minimize distortion of light rays transmitted through its wall. It is particularly advantageous that the bulb portion has a uniform wall thickness in the forward end crossing the central lamp axis A' because a substantial portion of the filament 38 lies on the central axis A' through the lamp 14.

Conventional wisdom in light fixture design teaches that filaments should optimally be placed at the focal point of the reflector. This position follows from basic geometry principles. However, this premise has surprisingly been found to be not valid for both the parabolic and near-parabolic reflector and the ellipsoidal and near-ellipsoidal reflector. Instead, the light source should be centered in front of or behind the focal point for parabolic and ellipsoidal reflectors, respectively. For an ellipsoidal reflector system, the optimum placement of a light source is about one tenth the axial distance between the near focal point and the reflector/mirror surface.

Figure 3:
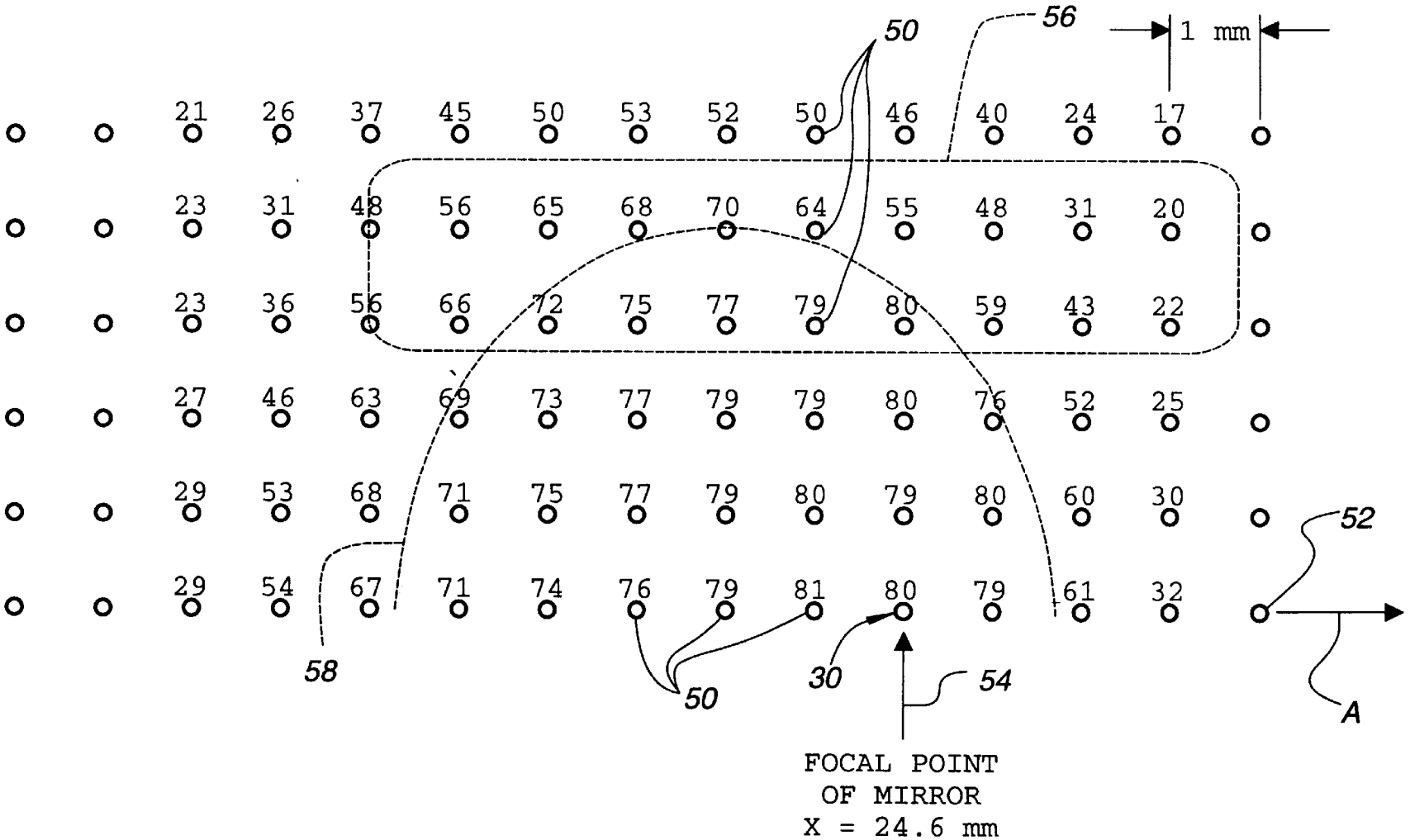
FIG. 3 is a plot of relative light-projection intensities for point light sources placed in a spatial longitudinal cross section about a focal point of an ellipsoidal reflector.
Figure 4:
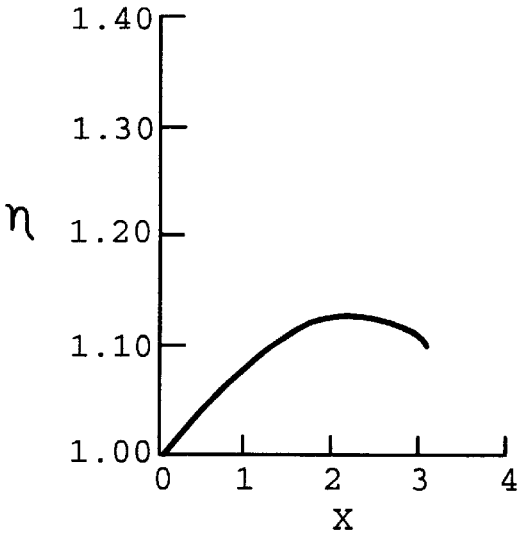
FIG. 4 is a graph of illumination efficiency, for an existing lamp design with a nearly elliptical reflector, versus axial position of the filament center behind the focal point of the reflector.

This phenomenon for an ellipsoidal reflector has been confirmed by our analysis. Referring now to FIG. 3, a longitudinal sectional plot of relative light projection intensities in a system comprising a point light source and an elliptical reflector 12 is shown. This plot was generated by a ray-trace simulation, using Monte-Carlo mathematical modeling techniques, for an ellipsoid with a focus axially 24.6 millimeters from the reflecting surface. Each circular dot 50 represents placement of the point source. Each dot 50 represents a spatial position annulus extending around the central axis 52 of the reflector 12. The focal point 30 of the reflector on the central axis 52 is indicated by the arrow 54. Each of the numbers above the dots 50 in the representative plot represents the relative intensity on a target from an elliptical reflector 12, axially spaced 24.6 millimeters from the focal point 30, and a point light source positioned at that particular spatial location. The distance between each dot is one millimeter. Thus the plot shown provides a 6×12 mesh of dots 50 spaced 1 mm apart.

This plot of FIG. 3 clearly shows, surprisingly, that for an ellipsoidal reflector and point-light-source system, the higher intensities lie generally between 1 millimeter ahead and 5 millimeters behind the focal point. More specifically and importantly, the highest intensities, having values of about 69 or 70 and greater, lie approximately within a generally spherical region centered about a point between about 2 to 3 millimeters behind the focal point, i.e., approximately one tenth the distance between the reflector surface and the focal point of the reflector.

The conventional lamp, as disclosed in U.S. Pat. No. 5,268,613 for an ellipsoidal spotlight and discussed above, has four linear, helical wound filament segments which are each spaced symmetrically from the central axis of the lamp, and the reflector, and approximately centered about the focal point. In order to determine whether a conventional spotlight could be improved, a commercial Source 4 light assembly and lamp constructed in accordance with this patent were measured. The focal point was 24.6 mm from the reflector. Each of the filament segments had a length of about 10.2 millimeters and was spaced about 3.5 mm from the central axis of the lamp. Since there are four linear, helical wound filament segments, the total filament length was about 40.8 mm.

The position of this conventional filament is shown superimposed onto the plot of FIG. 3 by dashed line 56. It can readily be seen that light emitted from the forward end and rear end portions of the conventional filament 56 is reflected with comparatively low efficiency. No matter where axially the filament is placed, it is not efficiently positioned because it is spaced from the central axis 52. However, an optimal axial position for this conventional filament arrangement would be between about 2 and 3 millimeters rearward, axially away from the focal point and toward the rear surface of the reflector 12.

Figure 5:
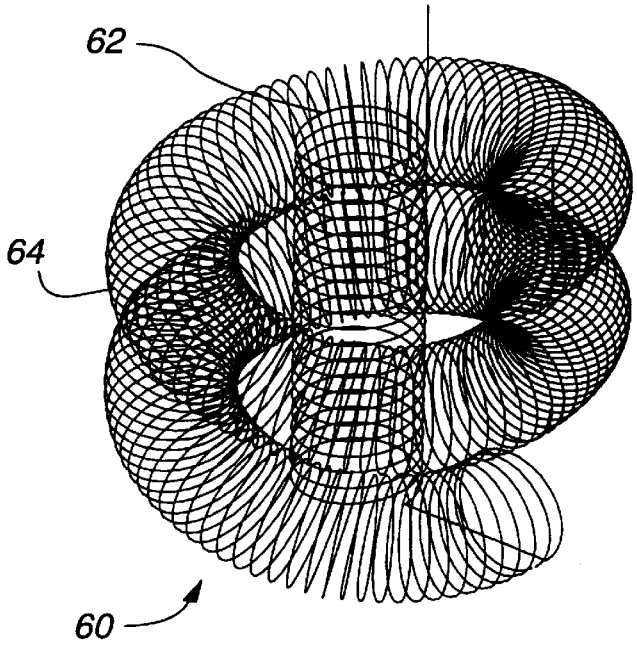
FIG. 5 is a perspective view of a first embodiment of a filament in accordance with the present invention.

A graph of calculated efficiencies ($\eta$),versus axial position of the filaments of the conventional lamp in a Source 4 system is shown in FIG. 5. The focal point is designated x=0 and distance rearward from the focal point extends to the right along the x axis. The efficiency is defined as the ratio of light delivered onto a target to the light delivered onto the same target with the filaments centered about the focal point at x=0. Thus, at x=0, $\eta$=1.0. As the upwardly sloped line of the graph indicates, the efficiency steadily and substantially improves as the filament center is initially moved toward the rear of the reflector. The peak efficiency of about 1.12 occurs when the filament center is located approximately 2–3 millimeters behind the focal point.

A system 10 in accordance with the present invention for optimally projecting a light beam generally comprises a reflector 12 having a central axis A' and a focal point 30 on the axis and a light source located behind the focal point 30. More particularly, the light source preferably is located within the region of greatest illumination intensity. The light source may be an illuminating ball of plasma or an incandescent filament in an incandescent lamp. The presently available lamp such as the ETC Source 4 lamp is inefficient as discussed above. Thus an improved incandescent lamp design is required. Such a configuration requires that the lamp filament be located within this high-intensity region. This region is roughly indicated by the dashed line 58 in the plot of FIG. 3.

Figure 6:
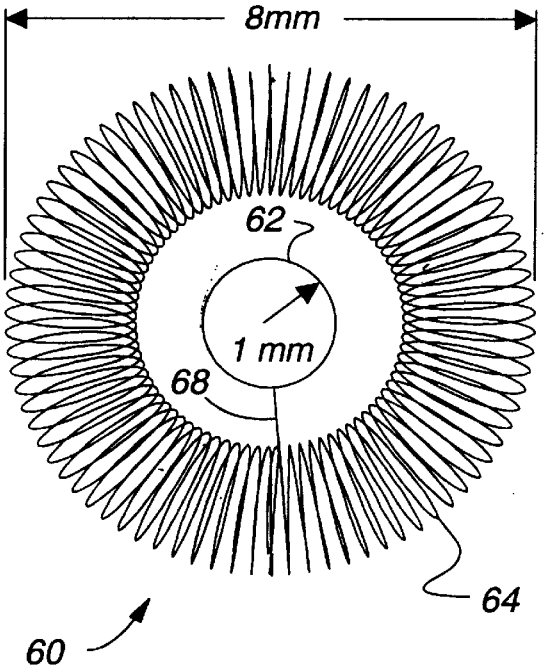
FIG. 6 is an end view of the filament shown in FIG. 5.
Figure 7:
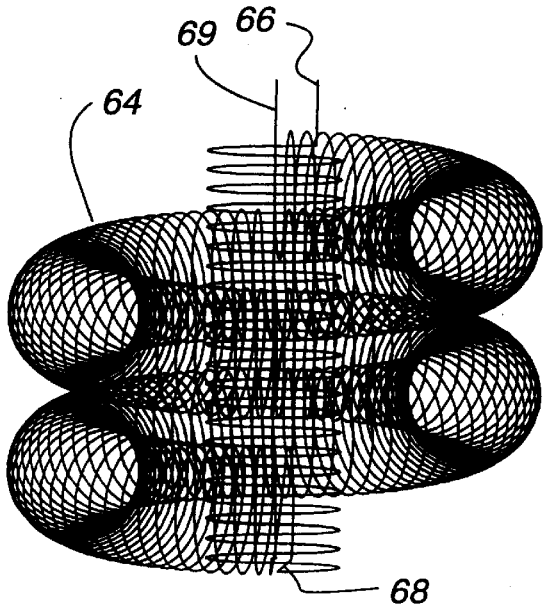
FIG. 7 is a side view of the filament shown in FIG. 5.

A first embodiment of an incandescent lamp filament 38 for use in a lamp 14 in accordance with the present invention is shown in FIGS. 5 through 8. Referring specifically to FIGS. 5, 6, and 7, the filament 38 is a helical wound coil 60 of preferably tungsten wire having a central straight portion 62 in series with a peripheral helix portion 64. The central portion 62 is a straight, or linear, helical winding which extends concentrically about the central axis A' of the incandescent lamp 14 thus, when installed in the system 10, extends coaxially with the central axis A of the reflector 12. The free end 66 of the straight portion 62 is preferably supported from an insulating standoff of conventional design and is electrically connected to one pin 34 of the lamp base portion 26. The peripheral helix portion 64 is joined to the straight central portion 62 by a radially extending portion 68 which may be supported by a hook or other fastener to another insulating standoff toward the forward end of the lamp bulb portion 24. The free end 69 of the helix peripheral portion 64 is electrically connected to the other pin 34 of the base portion 26.

The peripheral helix portion 64 preferably forms two full turns around the central portion 62 as is shown in FIGS. 5, 6 and 7. Utilizing, for example, 0.2 mm diameter tungsten wire, with a 0.1 mm spacing between each of the turns, each turn in both portions having a radius of 1 mm, the helical windings of the central straight portion 62 and the peripheral helix portion 64 form a filament structure having an overall axial length of about 7.0 mm. The peripheral portion preferably may have a radius of about 3 mm and thus the overall structure has an outer diameter of about 8 mm. As can be readily seen in the end view of FIG. 6, the central portion 62 and the peripheral portion 64 are spaced apart radially by about 0.5 mm to provide adequate clearances. The total length of the straight and peripheral portions is about 40.8 mm and therefore provides the same winding resistance as the conventional filament in the Source 4 lamp discussed above.

Figure 8:
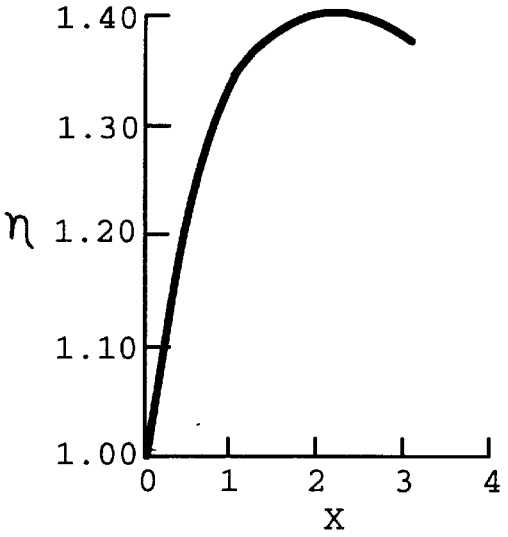
FIG. 8 is a graph of illumination efficiency for a system with a lamp design in accordance with a first embodiment of the invention having a cylindrical two-turn helix peripheral filament portion in conjunction with a nearly elliptical reflector compared to the conventional design versus axial position of the filament center behind the focal point of the reflector.

FIG. 8 is a graph of light-transmission efficiency versus axial distance from the focus of the ellipsoidal reflector 12 for this new filament design relative to the conventional design. Specifically, the efficiency ($\eta$) is defined as the ratio of light delivered onto a target by the new design to the light delivered onto the same target by the prior-art lamp design discussed above when the prior-art filament, shown in FIG. 3 as line 56, is optimally placed with its center located about 2 millimeters behind the focal point 30. Distance in millimeters along the central axis toward the reflector 12 is indicated as positive. The focal point is at x=0. In order to obtain the efficiency, a ray-trace simulation, utilizing a Monte-Carlo technique, was used to analyze rays that clear the structure of the filament, i.e., are not absorbed by adjacent winding wires. Rays transmitted through the design structure were simulated individually until a total of 10,000 rays had been analyzed. As can readily be seen, the efficiency of the embodiment 60 in a system 10 in accordance with the invention when compared to the conventional system filaments optimally placed behind the focal point 30 also peaks predictably at a center located about 2 millimeters behind the focal point of the reflector 12. This improved efficiency is about 40% greater than the comparable conventional design.

Figure 9:
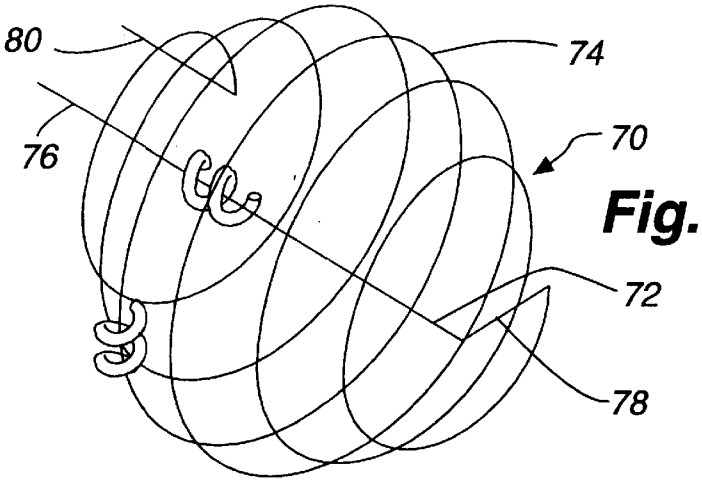
FIG. 9 is a perspective view of a second lamp filament in accordance with the present invention.
Figure 10:
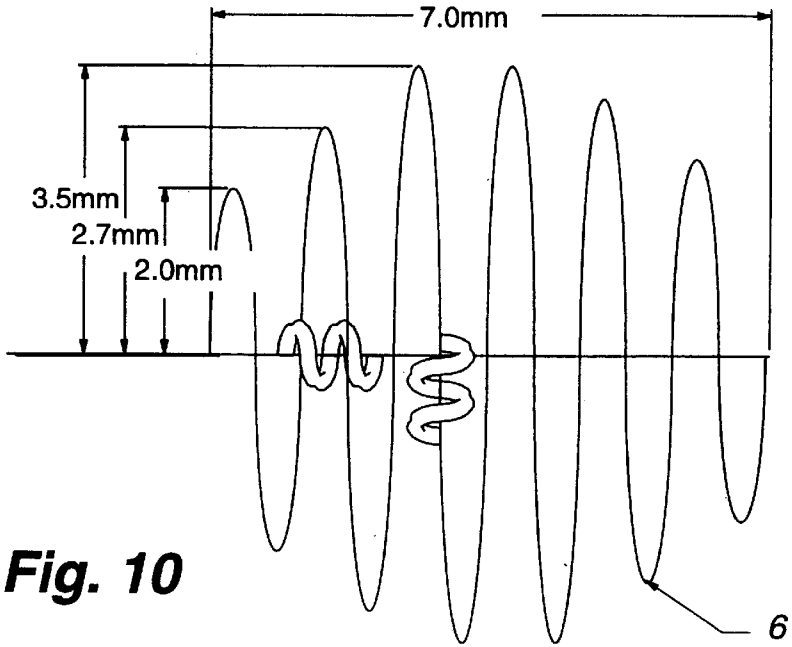
FIG. 10 is a side view of the second lamp filament shown in FIG. 9.

A second embodiment 70 of a filament for use in a lamp 14 in accordance with the invention is shown in FIGS. 9 and 10. In this embodiment, the filament 70 also has a central linear helically wound portion 72 joining, a peripheral helix portion 74. However, in this embodiment, the peripheral helix portion centerline radius varies to form a generally spherically shaped helix around the central portion 72. The peripheral helix portion may have at least four or more turns in the helix, depending on the wire size, coil size and spacing. In this illustrated embodiment, the central linear helix portion 72 has a coil radius of about 0.67 mm and a coiled length of about 7 mm. The free end 76 of the central linear coil portion 72 is again connected to one of the electrical connecting pins 34 of the base portion 24 of the lamp 14. The other end 78 of the linear portion 72 extends radially outward from the central axis A' to the upper end of the helix peripheral portion 74. The peripheral portion 74 preferably has six turns. The first and sixth turns each has a radius of 2 mm. The second and fifth turns each has a radius of 2.7 mm. The third and fourth turns each has a radius of 3.5 mm. The free end 80 of the helix portion 74 electrically connects to the other of the connecting pins 34. This configuration yields an efficiency improvement as shown in FIG. 11.

Figure 11:
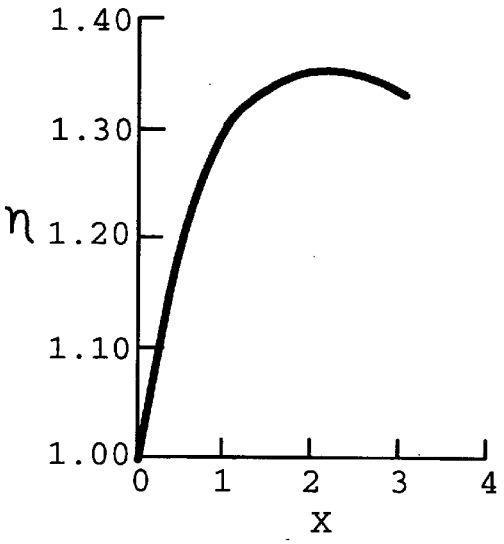
FIG. 11 is a graph of illumination efficiency for a system with a lamp design in accordance with a second embodiment of the invention having a spherical six turn peripheral filament portion in conjunction with a nearly elliptical reflector compared to a conventional design versus axial position of the filament center behind the focal point of the reflector.

FIG. 11 is a graph of light-transmission efficiency versus axial distance from the focus of the ellipsoidal reflector 12 for this second new filament design shown in FIGS. 9 and 10 relative to the conventional design. Again, the efficiency (η) is defined as the ratio of light delivered onto a target by the new design to the light delivered onto the same target by the prior-art lamp design discussed above when the prior-art filament, shown in FIG. 3 as line 56, is optimally placed with its center located 2 millimeters behind the focal point 30. Distance in millimeters along the central axis toward the reflector 12 is indicated as positive. The focal point is at x=0. Again, the ray trace simulations were performed as described above until a total of 10,000 rays which pass through the filament structure had been considered. As can readily be seen, the efficiency of the embodiment 70 in a system 10 in accordance with the invention when compared to the conventional system filaments optimally placed behind the focal point 30 again also peaks predictably at a center located about 2 millimeters behind the focal point of the reflector 12. This improved efficiency is about 40% greater than the comparable conventional design previously discussed above. This graph is almost identical to that shown in FIG. 8.

Figure 13:
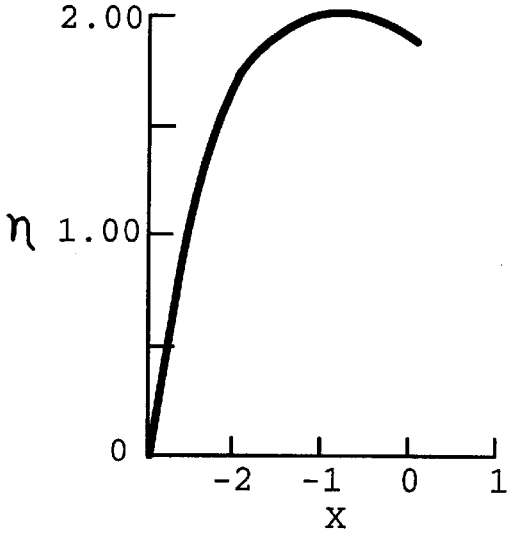
FIG. 13 is a graph of illumination efficiency for a lamp design in accordance with a first embodiment of the invention having a two turn helix peripheral filament portion in conjunction with a nearly parabolic reflector versus axial position of the filament center around the focal point of the reflector.
Figure 12:
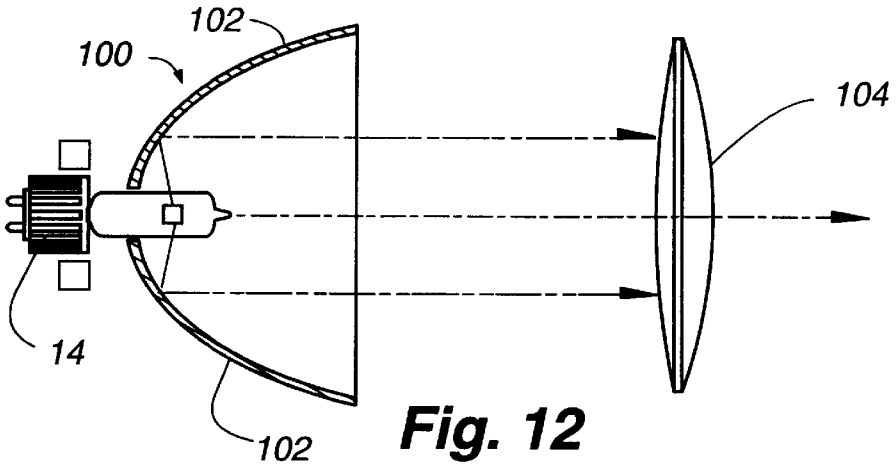
FIG. 12 is a schematic side view of another embodiment of the system in accordance with the present invention utilizing a parabolic reflector and light source.
Figure 11:
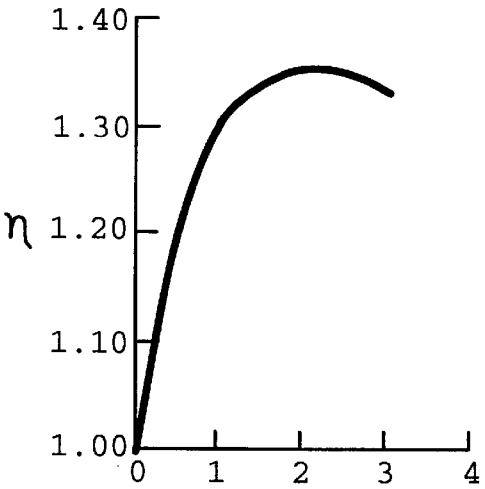

Another embodiment of the system in accordance with the present invention is shown in FIG. 12. The system 100 incorporates a parabolic reflector 102 and optionally a lens 104 along with one of the improved lamps 14 preferably having a cylindrical configuration filament as is shown in FIGS. 5 through 7. FIG. 13 is a graph of efficiency of the lamp design compared to the conventional lamp design versus the position of the filament center along the central axis of the lamp 14 and the reflector 102. This graph was Generated utilizing the ray trace methodology described immediately above. Utilizing this filament design, the light-transmission efficiency (η) is improved to about twice that of the conventional lamp design and again, the best efficiency is surprisingly located at a position other than the focal point of the parabolic reflector. In FIG. 13, negative distance along the x axis is forward of the focal point at x=0 and positive distance is behind the focal point. In this case, the optimum position is surprisingly forward of the focal point, preferably about 0.5 to 1 mm forward.

The present invention may be practiced otherwise than as specifically described above. Many changes, alternatives, variations, and equivalents to the various structures shown and described will be apparent to one skilled in the art. For example, the filament radii may be changed, additional insulating wire support members may be provided, different wire diameters, lengths and spacings may be provided. In addition, the peripheral portions 64 and 74 may have other than cylindrical and spherical shapes, for example, a generally double conical or double pyramidal shape. Accordingly, the present invention is not intended to be limited to the particular embodiments illustrated but is intended to cover all such alternatives, modifications, and equivalents as may be included within the spirit and broad scope of the invention as defined by the following claims. All patents, patent applications, and printed publications referred to herein are hereby incorporated by reference in their entirety.

What is claimed is:

1. An incandescent light lamp comprising:

a base;

a glass envelope connected to said base and surrounding an illuminating filament therein positioned along a longitudinal axis through said base and said envelope, said filament having a central helically wound straight portion extending along said axis and a peripheral helically wound portion wrapped around said straight portion.

2. The lamp according to claim 1 wherein said peripheral portion wraps in a spiral around said straight portion.

3. The lamp according to claim 2 wherein said peripheral portion wraps cylindrically around said straight portion.

4. The lamp according to claim 2 wherein said peripheral portion extends spherically around said straight portion.

5. The lamp according to claim 1 wherein said peripheral portion has at least two full wraps around said straight portion.

6. The lamp according to claim 4 wherein said peripheral portion has at least 4 full wraps around said straight portion.

7. An incandescent filament for use in an incandescent lamp having a central axis, said filament comprising a helically wound central straight portion adapted to be positioned coaxially on said lamp central axis and a peripheral helically wound peripheral portion spirally wrapped around said central straight portion.

8. The filament according to claim 7 wherein said peripheral portion wraps at least two full turns around said central portion.

9. The filament according to claim 8 wherein said peripheral portion cylindrically wraps around said central portion.

10. The filament according to claim 8 wherein said peripheral portion spherically wraps around said central portion.

* * * * *